United States Patent [19]

Minami

[11] Patent Number: 4,949,434

[45] **Date of Patent: * Aug. 21, 1990**

[54] SLIDE FASTENER SLIDER

[75] Inventor: Hiroo Minami, Uozu, Japan

[73] Assignee: Yoshida Kogyo K.K., Tokyo, Japan

[ * ] Notice: The portion of the term of this patent subsequent to Dec. 13, 2005 has been disclaimed.

[21] Appl. No.: 192,605

[22] Filed: May 11, 1988

[30] Foreign Application Priority Data

May 22, 1987 [JP] Japan ..... 62-76900[U]

[51] Int. Cl.[5] ..... A44B 19/26

[52] U.S. Cl. ..... 24/429; 24/431

[58] Field of Search ..... 403/326; 24/429, 431, 24/415, 419–426

[56] References Cited

U.S. PATENT DOCUMENTS

| | | | |
|---|---|---|---|
| 2,066,061 | 12/1936 | Sundback . | |
| 2,289,955 | 7/1942 | Berg . | |
| 2,307,711 | 1/1943 | Schaaff . | |
| 2,840,877 | 7/1958 | Foltis . | |
| 2,864,146 | 12/1958 | Morin . | |
| 3,028,647 | 4/1962 | Greenberg | 24/420 |
| 4,055,876 | 11/1977 | Ackermann et al. . | |
| 4,123,828 | 11/1978 | Akashi | 24/422 |
| 4,389,758 | 6/1983 | Akushi | 24/429 |
| 4,471,496 | 9/1984 | Gardner, Jr. et al. | 403/326 X |
| 4,790,050 | 12/1988 | Ishii | 24/429 |

FOREIGN PATENT DOCUMENTS 3637726 5/1987 Fed. Rep. of Germany .

*Primary Examiner*—James R. Brittain

*Attorney, Agent, or Firm*—Hill, Van Santen, Steadman & Simpson

[57] ABSTRACT

A slide fastener slider includes a safe pull tab molded of elastic synthetic rubber into a one-piece structure. The elastic pull tab is easily bendable when subjected to a severe pressure or force and hence never injures the user's body even when the user accidentally strikes a part of its body against the pull tab.

2 Claims, 2 Drawing Sheets

SLIDE FASTENER SLIDER

BACKGROUND OF THE INVENTION

1. Field of the Invention:

This invention relates generally to sliders for slide fasteners, and more particularly to a slide fastener slider having a safe pull tab which is suitable for use on sportswear and infants' wear.

2. Description of the Related Art:

In general, pull tabs for slide fasteners are made of metal such as a zinc alloy, copper alloy, stainless steel and the like which is the same material as the slider bodies on which the pull tabs are pivotably mounted. However, there is a demand in the market for a slider having a pull tab which is made of a different material from the slider body to meet the user's desire.

To meet such demand, the present assignee has proposed a slider of this type, as disclosed in Japanese Utility Model Application No. 60-195055. The disclosed slider, as reillustrated here in FIG. 4 of the accompanying drawings, includes a pull tab A made of rubber connected to a slider body via a connector ring B threaded through an arch-shaped lug C of the slider body. Since the connector ring B is made of metal, there is a possibility of injury when the user hits a part of its body against the metal connector ring. This slider is therefore not suitable for use on sportswear and infants' wear.

SUMMARY OF THE INVENTION

With the foregoing drawback in view, it is an object of the present invention to provide a slider having a safe pull tab which is free from a possibility of injury even when the user accidentally strikes a part of its body against the pull tab.

According to the present invention, the foregoing and other objects are attained by a slide fastener slider comprising: a slider body having an pull-tab supporting portion; and a one-piece pull tab made of elastic synthetic rubber and pivotably connected at its one end to the pull-tab supporting portion. The elastic pull tab may have a thin portion disposed centrally between the free end and an opening defined adjacent to the one end so that the pull tab can be easily be bent when subjected to a severe pressure or force.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
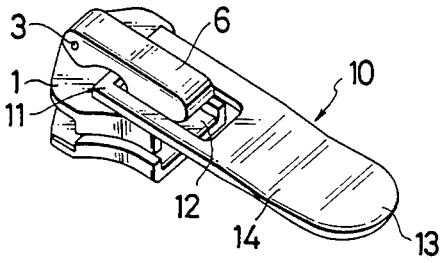
FIG. 1 is a perspective view of a slide fastener slider embodying the present invention.

The principles of the present invention are particularly useful when embodied in a slide fastener slider such as shown in FIG. 1. The slider is of the semiautomatically lockable slider in which a slider pull tub is set in an upright position when the slider is operated to open and close a slide fastener, and hence there is a great possibility of injury when the user accidentally hits a part of its body onto the erected pull tab.

Figure 2:
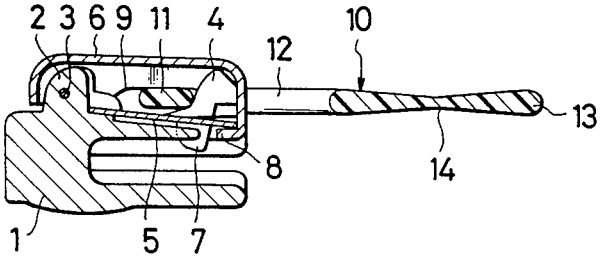
FIG. 2 is an enlarged longitudinal cross-sectional view of the slider with parts in locking position.

As shown in FIGS. 1 and 2, the slider includes a slider body 1 having on its upper surface a support lug 2 and a hook-shaped stopper 4 disposed adjacent to the front and rear ends, respectively, of the slider body 1. The slider body 1 has an aperture formed in an upper wing or plate thereof for the passage of a locking prong 7. The locking prong 7 is integrally formed on an inner surface of an arch-shaped cover 6 adjacent to the rear end thereof. The cover 6 has a front end pivoted by a pin 3 to the support lug 2 and extends longitudinally over the upper wing of the slider body 1 so as to conceal the support lug 2 and the stopper 4. A leaf spring 5 is disposed flatwise against the upper wing and is snuggly received between the support lug 2 and the stopper 4. The leaf spring 5 has a rear end held in interlocking engagement with a locking projection 8 of the cover 8. Thus, the cover 6 is normally urged downwardly against the upper wall under the force of the leaf spring 5, as shown in FIG. 1. In this instance, the locking prong 7 on the cover 6 projects through the aperture into a Y-shaped guide channel in the slider body 1, thereby locking the slider in position against displacement relative to a slide fastener chain (not shown). The cover 6 has a pair of spaced side walls recessed as at 9 so as to provide curved cam surfaces.

The slider also includes a pull tab 10 pivotably connected to the cover 6 of the slider body 1 (in the illustrated embodiment, the cover 6 constitutes a pull-tab supporting portion). The pull tab 10 is rectangular in shape and made of elastic synthetic rubber such as polyester elastomer, for example. The pull tab 10 has a pintle portion or spindle 11 at an end thereof and a rectangular opening 12 partly defined by the spindle 11. The spindle 11 is threaded through a space defined between the cam surfaces 9 and the upper wing so that the pull tab 10 is pivotable about the spindle 11 in a plane perpendicular to the general plane of the upper wing. The spindle 11 has a non-circular cross sectional shape and engageable with the cam surfaces 9 of the cover 6 to pivot the cover 6 as described later. The pull tab 10 is reduced in thickness at a portion 14 disposed centrally between the opening 12 and the free end 13 of the pull tab 10. With the thin portion 14 thus provided, the pull tab 10 is easily bendable about the thin portion 14 when subjected to a severe pressure or force.

Figure 3:
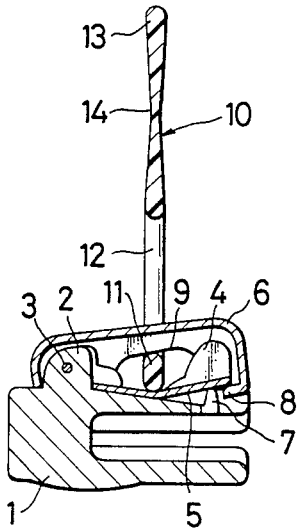
FIG. 3 is a view similar to FIG. 3, but showing the slider with parts in unlocking position.
Figure 4:
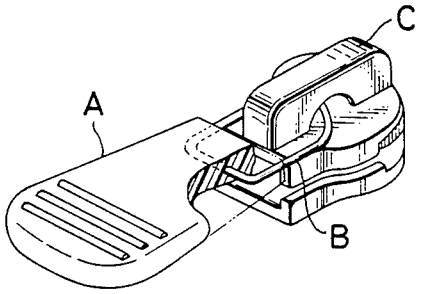
FIG. 4 RELATED ART
FIG. 4 a perspective view, with part cut away for clarity, of a slider according to a related art.

In use, when the slider is to be moved to open and close the slide fastener, the pull tab 10 is uplifted by the user's fingers from the locking position shown in FIG. 2 to the unlocking position shown in FIG. 3. During that time, due to camming action between the spindle 11 and the cam surfaces 9, the cover 6 is pivoted upwardly about the pin 3 against the force of the leaf spring 5 to cause the locking prong 7 to be retracted from the guide channel into the aperture in the upper wing, thereby releasing the slider from the slide fastener chain. Upward movement of the cover 6 is limited by the stopper 4 engageable with the locking projection 8 of the cover 6. When the pull tab 10 is held in this erected position, there is a great possibility of accidental engagement with the user's body. At the time of this accidental engagement, the pull tab 10 of the present invention never injures the user's body as it is made of elastic synthetic rubber and also is easily bendable about the thin portion 14.

When the pull tab 10 is turned in either direction (i.e. forwardly or rearwardly of the slider body 1), the cover 6 is automatically returned to its normal locking position under the force of the leaf spring 5, thereby bringing the locking prong 7 into locking engagement with the slide fastener chain. The slider is thus locked in position against displacement with respect to the slide fastener chain.

As described above, the pull tab 10 solely made of elastic synthetic rubber is easily bendable when subjected to a severe external force or pressure hence is unlikely to injure the user's body even when the user accidentally hits a part of its body against the pull tab 10.

The pull tab 10 of the present invention is also applicable to other types of slider which include a general slider having no locking function, an automatically lockable slider, a bi-directional openable slide fastener slider having two pull tabs. Furthermore, the pull tab 10 may be formed into various shapes including an oval and a fan-shape.

Obviously, various modifications and variations of the present invention are possible in the light of the above teaching. It is therefore to be understood that within the scope of the appended claims the invention may be practiced otherwise than as specifically described.

What is claimed is:

1. A slide fastener comprising:

(a) a slider body having a pull-tab supporting portion; and (b) a one-piece solid non-hollow pull-tab made of elastic synthetic rubber and pivotally connected at its one end to said pull-tab supporting portion;

said elastic pull-tab having two opposite ends and a portion disposed centrally between said two opposite ends of said pull-tab, said portion being thinned relative to said ends.

2. A slide fastener slider according to claim 1, said elastic synthetic resin comprising an polyester elastomer.

* * * * *